US007402538B2

(12) United States Patent
Bader et al.

(10) Patent No.: US 7,402,538 B2
(45) Date of Patent: Jul. 22, 2008

(54) FABRIC FOR PROTECTIVE GARMENTS

(75) Inventors: Yves Bader, Thoiry (FR); Andre Capt, Gland (CH)

(73) Assignee: E.I. du Pont de Nemours and Company, Wilmington, DE (US)

( * ) Notice: Subject to any disclaimer, the term of this patent is extended or adjusted under 35 U.S.C. 154(b) by 263 days.

(21) Appl. No.: 11/044,241

(22) Filed: Jan. 27, 2005

(65) Prior Publication Data

US 2005/0221706 A1 Oct. 6, 2005

(51) Int. Cl.
*D03D 15/12* (2006.01)
*D03D 15/00* (2006.01)

(52) U.S. Cl. ..... 442/209; 442/203; 442/208; 442/301; 442/302; 428/920; 428/921; 139/420 R

(58) Field of Classification Search ..... 442/301, 442/302, 203, 208, 209; 428/920, 921; 139/420 R
See application file for complete search history.

(56) References Cited

U.S. PATENT DOCUMENTS 4,014,829 A 3/1977 Baird et al.

FOREIGN PATENT DOCUMENTS

| | | |
|---|---|---|
| EP | 0 330 163 A2 | 8/1989 |
| WO | WO00/66823 | 11/2000 |
| WO | WO 02/079555 A2 | 10/2002 |

*Primary Examiner*—Jenna-Leigh Johnson

(57) ABSTRACT

This invention relates to heat and flame resistant single ply fabric for use as a single or outer layer of a protective garment for a wearer. The fabric comprises at least one warp system and at least two weft systems. The warp system comprises a blend of 60 to 90 wt-% poly-m-phenylenisophtalamid (meta-aramid) and 10 to 40 wt-% poly-p-phenylenterephtalamid (para-aramid). The first of the at least two weft systems comprises a blend of 85 to 95 wt-% meta-aramid and 5 to 15 wt-% para-aramid. The second of the at least two weft systems essentially comprises para-aramid.

10 Claims, 1 Drawing Sheet

FABRIC FOR PROTECTIVE GARMENTS

BACKGROUND OF THE INVENTION

1. Field of the Invention

The invention relates to a heat and flame resistant fabric for use as single or outer layer of protective garments.

2. Description of Related Art

A garment protecting against heat and flame is also known as "Turn Out Coat" and is usually used as uniform to identify, for example, a fire fighter. Such garment is normally quite heavy because the mass and the thickness of the garment itself are normally the main factors conferring protection. The wearer of such a garment is therefore limited in his movements and undergoes heat stress so that the overall wear comfort strongly decreases. In the last twenty years, attempts have continuously been made to develop new materials in order to improve the wear comfort of such protective garments. For example, lighter but more voluminous insulating materials have been developed for this purpose. These materials confer more lightness to the final protective garment but they might affect the respiratory activities of the wearer due to their cumbersome dimensions. Furthermore, the freedom of movement is not necessarily improved by using these materials.

Garments protecting against heat and flame are usually made of one or more layers. The choice of the different materials and of the number of layers constituting the final protective garment depends on the specific application of the garment itself.

When designing a new protective garment, care must be taken that all criteria of the relevant national and international norms are fulfilled. As an example, heat and flame resistant garments must be manufactured in accordance with EN-340, EN-531, EN 469 as well as NFPA 1971:2000, NFPA 2112:2001, and NFPA 70E:2000. For instance, a lighter protective garment could be manufactured by simply using lighter materials. However, this is usually associated with a decrease of the mechanical and thermal properties of the protective garment.

Furthermore, the Turn Out Coats are normally used by most of the fire brigades for an average period of five years and, therefore, it is expected that they fully maintain their performance in terms of heat and flame resistance, as well as in terms of their esthetic appearance, during such period of time.

WO 00/066823 discloses a fire resistant textile material comprising a woven faced fabric which may include poly-m-phenylenisophtalamid (meta-aramid) fibers, the fabric including a woven mesh back of low thermal shrinkage fibers.

WO 02/079555 discloses a reinforced fabric comprising a ground fabric having on its rear surface a reinforced grid consisting of warp and weft yarns produced in a material having higher mechanical properties than those producing the yarns of the ground fabric. In such reinforced fabric, the reinforcing grid is linked to the ground fabric by its warp and weft yarns which are fixed on the ground fabric in different points and which intersect each other outside the ground fabric.

The products developed under the two prior art documents mentioned above increase the mechanical and thermal performance of single ply structures. However, by adding such a reinforcing grid at the backside of the single ply layer, the fabrics according to these prior art documents become a semi double weave structure so that their specific weights are necessarily higher than those of strict single ply fabrics.

The problem at the root of the present invention is therefore to provide a heat and flame resistant single ply fabric which maintains its performance and esthetic appearance over the years and which, if used as single or outer layer of protective garments, enables to increase wear comfort and to improve the dissipation of vapor and heat produced by the wearer.

BRIEF SUMMARY OF THE INVENTION

Now, it has been surprisingly found that the above mentioned problems can be overcome by a heat and flame resistant single ply fabric for use as single or outer layer of a protective garment for a wearer, characterized in that it comprises at least one warp system and at least two weft systems, the warp system comprising a blend of 60 to 90 wt-% poly-m-phenylenisophtalamid (meta-aramid) and 10 to 40 wt-% poly-p-phenylenterephtalamid (para-aramid), the first of the at least two weft systems comprising a blend of 85 to 95 wt-% meta-aramid and 5 to 15 wt-% para-aramid, the second of the at least two weft systems essentially comprising para-aramid, and characterized in that the fabric is woven in such a way that from about 55 wt-% to about 80 wt-% of the warp system appears on the fabric side facing the wearer, from about 55 wt-% to about 80 wt-% of the first of the at least two weft systems appears on the fabric side facing away the wearer and from about 70 wt-% to about 90 wt-% of the second of the at least two weft systems appears on the fabric side facing the wearer.

Another aspect of the present invention is a garment for protection against heat and flames comprising the above fabric as single or outer layer.

The garment according to the present invention strongly improves the wearer's comfort both during normal and critical situations. It is lighter and thinner than conventional garments having similar mechanical and thermal properties and it enables a higher heat and vapor dissipation from the wearer surface to the environment.

DETAILED DESCRIPTION OF THE INVENTION

Figure 1:
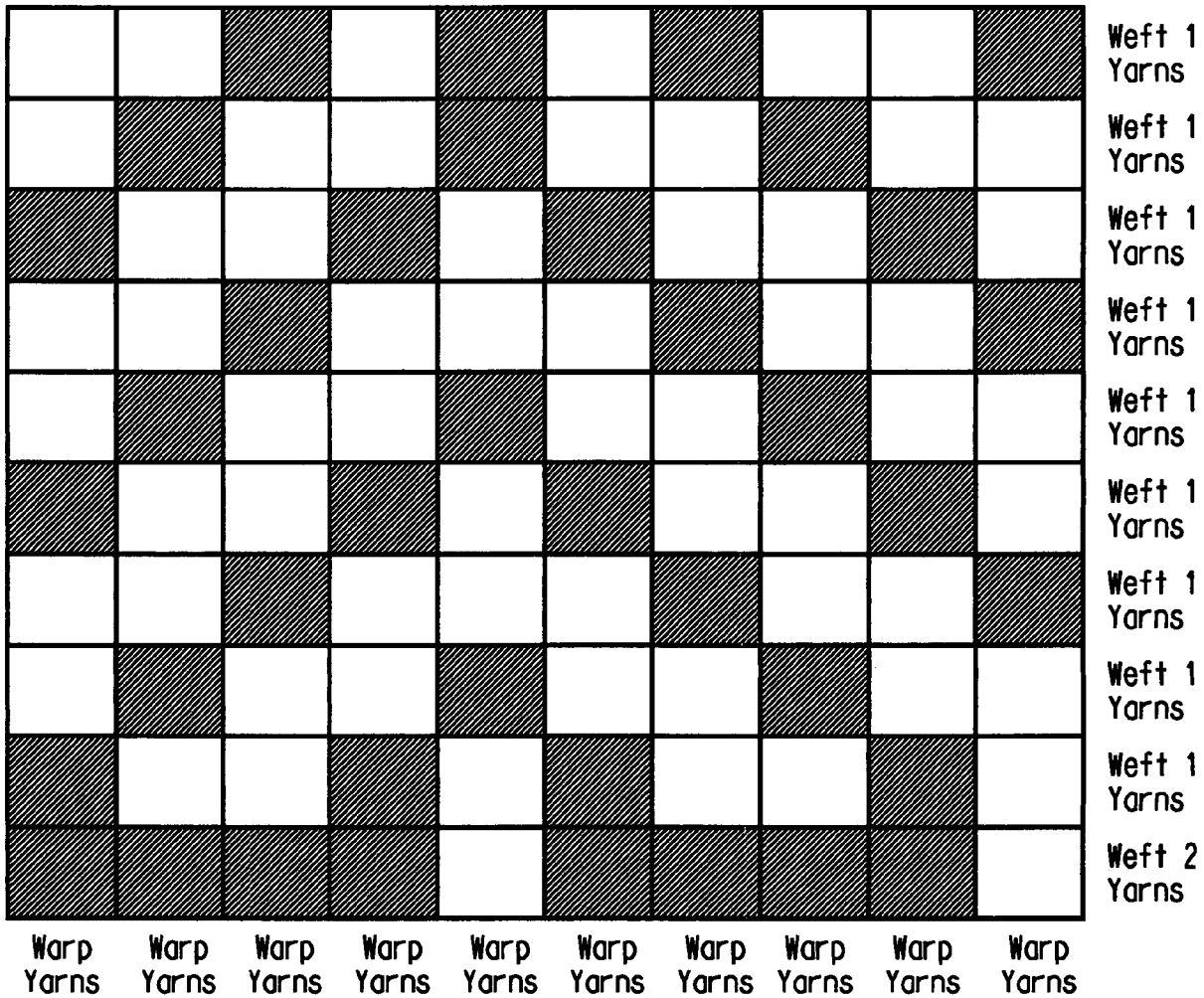
FIG. 1 is a schematic representation of the weave construction of a fabric according to the present invention (Example 1).

Due to its peculiar structure, the fabric according to the present invention can have a specific weight, which is lower than that of conventional fabrics having comparable mechanical and thermal properties when used as single or outer layer of a protective garment.

The fabric of the present invention has particularly good mechanical properties due to the structure of its weft system consisting in an alternating sequence of yarns including a substantial amount of meta-aramid fibers and yarns essentially comprising para-aramid fibers. The particular weave structure, according to which the fabric side facing the wearer includes more para-aramid fibers than the fabric side facing away the wearer, enables to confer to the fabric according to the present invention optimized thermal protection and esthetic appearance over time.

The optimal amount and distribution of the meta-aramid and para-aramid fibers throughout the two sides of the fabric according to the present invention depend on the specific applications and on the materials used. Generally speaking, the larger the amount of para-aramid fibers, the better the physical performance and resistance of the fabric itself to break open during thermal exposure. On the other hand, a too high concentration of para-aramid fibers in the fabric affects its flexibility and esthetic appearance. Preferably, the para-aramid fibers constitute about 15 to about 30 wt-% of the overall weight of the fabric.

Furthermore, the fabric according to the present invention can be manufactured under standard process conditions by using conventional machines for weaving single ply structures, thus rendering its production easier and more cost efficient.

Aramid materials suitable for the manufacture of the fabric according to the present invention can have various physical and chemical properties in accordance with the specific use of the fabric. Suitable meta-aramid and para-aramid materials are for example commercially available under the trademarks NOMEX® and KEVLAR®, respectively, from E. I. du Pont de Nemours and Company, Wilmington, Del., U.S.A.

According to a preferred embodiment of the present invention, the ratio between the first and the second of the at least two weft systems is chosen in such a way that the total wt-% ratio between meta-aramid and para-aramid in the at least two weft systems is substantially the same as the wt-% ratio between meta-aramid and para-aramid in the warp system. With the term "substantially the same", it is meant that the discrepancy between the values of the meta-/para-aramid wt-% ratio of the warp and the weft systems cannot exceed about 30% of the value of either the meta-/para-aramid wt-% ratio of the warp or of the weft systems. Advantageously, such discrepancy cannot exceed about 20% of the value of either the meta-/para-aramid wt-% ratio of the warp or of the weft system.

According to a preferred embodiment of the present invention, the warp and weft systems of the fabric are, independently to each other, based on filaments, single yarns and twisted yarns. By "filament" it is meant manufactured fibers which are extruded into filaments that are eventually converted into filament yarns. Advantageously, the warp and weft systems of the fabric according to the present invention are made of twisted yarns.

The linear mass of the yarns forming the warp and weft systems depends on the specific use of the fabric. Linear mass values are typically between about 200 and about 500 dtex.

According to another preferred embodiment of the present invention, the fibers constituting the first of the at least two weft systems have a linear mass from about 1.1 to about 1.4 dtex, the fibers constituting the second of the at least two weft systems have a linear mass from about 1.7 to about 2.4 dtex, and the fibers constituting the warp system have a linear mass value from about 1.7 to about 2.2 dtex. Such difference in the linear mass of the fibers constituting the warp and weft systems is mainly due to the fact that the finer the fibers the better thermal insulation they provide so that finer fibers will be advantageously used for the first of the at least two weft systems, which weft system predominantly appears on the fabric side facing away the wearer.

Accordingly, in order to further increase the insulation effect of the fabric, particularly for exposures to heat and flames of up to three (3) seconds, the linear mass values of the fibers constituting the weft systems will be preferably lower than those of the fibers constituting the warp system and the weft systems will appear more predominantly on the side of the fabric facing away the wearer.

Preferably, the fabric of the present invention has two weft systems, and its overall specific weight typically ranges from about 170 to about 250 g/m$^2$, preferably from about 180 to about 220 g/m$^2$.

Advantageously, the first of the at least two weft systems and the warp system of the fabric according to the present invention comprise each up to 4 wt-% of antistatic fibers. The presence of such fibers enables to prevent, to dissipate or at least to strongly reduce electrical charges that may be produced on the surface of the fabric. Any kind of antistatic fiber suitable for this purpose may be used. Examples thereof are inductive fibers such as carbon fibers sheeted with polyamide, semi-conductive fibers such as polyamide or polyester coated with cupper or silver and conductive fibers such as steel fibers.

A second aspect of the present invention is a garment for protection against heat and flames comprising a structure made of at least one layer of the fabric described above.

According to a preferred embodiment of the present invention the garment comprises a structure comprising an internal layer, optionally an intermediate layer made of a breathing waterproof material, and an outer layer made of the above-described fabric of the invention.

The internal layer, which faces the body of the wearer, can be an insulating lining made for example of a layer of two, three or more plies. The purpose of such lining is to have an additional insulating layer further protecting the wearer from the heat.

The internal layer can be made of a woven, a knitted, a non-woven fabric and composites thereof. Preferably, the internal layer is made of a fabric comprising non meltable fire resistant materials, such as a woven fabric quilted with a fleece both made of meta-aramid.

The garment according to the present invention can be manufactured in any possible way. It can include an additional, most internal layer made, for example, of cotton or other materials. The most internal layer is directly in contact with the wearer's skin or the wearer's underwear.

The garment according to the present invention can be of any kind including, but not limited to jackets, coats, trousers, gloves, overalls and wraps.

The invention will be further described in the following Examples.

EXAMPLES

Example 1 (Invention)

A blend of fibers, commercially available from E. I. du Pont de Nemours and Company, Wilmington, Del., USA under the trade name Nomex® N305 having a cut length of 5 cm and consisting of:

75 wt-% pigmented poly-metaphenylene isophthalamide (meta-aramid) 1.7 dtex staple fibers;

23 wt-% poly-paraphenylene terephthalamide (para-aramid) 1.7 dtex fibers; and 2 wt-% of carbon fibers sheeted with polyamide (antistatic fibers);

was ring spun into a single staple yarn (Y1) using a conventional cotton staple processing equipment.

Y1 had a linear mass of Nm 55/1 or 182 dtex and a twist of 871 Turns Per Meter (TPM) in Z direction and it was subsequently treated with steam to stabilize its tendency to wrinkle.

Two Y1 yarns were then plied and twisted together. The resulting plied yarn (TY1) had a linear density of Nm 55/2 or 364 dtex and a twist of 621 TPM in S direction. TY1 was used as warp yarn.

A blend of fibers, commercially available from E. I. du Pont de Nemours and Company, Wilmington, Del., USA under the trade name Nomex® N313, having a cut length of 5 cm and consisting of:

88 wt-% of pigmented poly-metaphenylene isophthalamide (meta-aramid), 1.4 dtex staple fibers;

10 wt-% of poly-paraphenylene terephthalamide (para-aramid) 1.7 dtex fibers; and 2 wt-% of carbon fibers sheeted with polyamide (antistatic fibers);

was ring spun into a single staple yarn (Y2) using a conventional cotton staple processing equipment.

Y2 had a linear mass of Nm 55/1 or 182 dtex and a twist of 890 TPM in Z direction and it was subsequently treated with steam to stabilize its tendency to wrinkle. Two Y2 yarns were then plied and twisted together. The resulting plied and twisted yarn (TY2) had a linear density of Nm 55/2 or 364 dtex and a twist of 620 TPM in S direction. TY2 was used as weft yarn.

Stretch broken fibers (100 wt-%) commercially available from E.I du Pont de Nemours and Company, Wilmington, Del., USA under the trade name Kevlar® T970 black were ring spun into a single staple yarn (Y3) using a conventional worsted staple processing equipment.

Y3 had a linear density of Nm 50/1 or 200 dtex and a twist of 560 TPM in Z direction and it was subsequently treated with steam to stabilize its tendency to wrinkle.

Two Y3 yarns were then plied and twisted together. The resulting plied yarn (TY3) had a linear density of Nm 50/2 or 400 dtex and a twist of 500 TPM in S direction. TY3 was used as weft yarn.

A fabric weave having a special weave plan as described in FIG. 1 was prepared. This fabric had 28 yarns/cm (warp) of TY1, 22 yarns/cm (weft) (20 yarns/cm of TY2 and 2 yarns/cm of TY3) and a specific weight of 185 g/m$^2$. The warp system predominantly appeared on the fabric side facing the wearer (61%), the first of the two weft systems predominantly appeared on the fabric side facing away the wearer (65%) and the second weft system predominantly appeared on the fabric side facing the wearer (80%).

The following physical tests were carried out on the fabric described in this Example 1:

Determination of the breaking strength and elongation according to ISO 5081;

Determination of the tear resistance according to ISO 4674/2;

Combined radiant and convective heat testing according to the Thermal Protection Performance Test (TPP) method (ISO-FDIS 17492) as a single layer with a heat flux calibrated to 2.0 cal/cm$^2$/s, TPP being the factor measuring the energy in (cal/cm$^2$) necessary to simulate a second-degree burn on the skin of an individual;

The Fabric Failure Factor (FFF) which is defined as follows: FFF=100×TPP (cal/cm$^2$)/fabric weight (g/m$^2$);

The fabric described in this Example 1 was tested both as single layer ("Fabric" in Tables I and II) and as the outershell of a multi layer structure ("Garment" in Tables I and II) which further comprised 1) an intermediate layer of a poly tetrafluoroethylene (PTFE) membrane laminate on a non-woven fabric made of 85 wt-% Nomex® and 15 wt-% Kevlar® and having a specific weight of 135 g/m$^2$ (commercially available under the trade name GORE-TEX® Fireblocker N from the company W.L. Gore and Associates, Delaware, U.S.A.), and 2) an internal layer of a meta-aramid thermal barrier having a weight of 140 g/m$^2$ quilted on a 100 wt-% Nomex® N 307 fabric having a specific weight of 110 g/m$^2$.

The results are given in Table I.

Example 2 (Comparative)

A blend of fibers, commercially available from E. I du Pont de Nemours and Company, Wilmington, Del., USA under the trade name Nomex® N305 having a cut length of 5 cm and consisting of:

75 wt-% pigmented poly-metaphenylene isophthalamide (meta-aramid) 1.7 dtex staple fibers;

23 wt-% poly-paraphenylene terephthalamide (para-aramid) 1.7 dtex fibers; and 2 wt-% of carbon fibers sheeted with polyamide (antistatic fibers);

was ring spun into a single staple yarn (Y1) using a conventional cotton staple processing equipment.

Y1 had a linear mass of Nm 55/1 or 182 dtex and a twist of 871 Turns Per Meter (TPM) in Z direction and it was subsequently treated with steam to stabilize its tendency to wrinkle.

Two Y1 yarns were then plied and twisted together. The resulting plied yarn (TY1) had a linear density of Nm 55/2 or 364 dtex and a twist of 621 TPM in S direction. TY1 was used as warp yarn.

Figure 2:
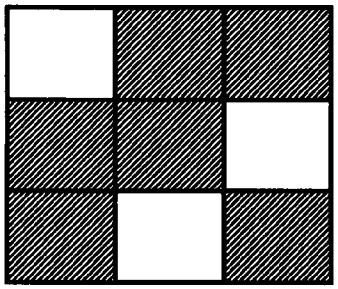
FIG. 2 is a schematic representation of the weave construction of a comparative fabric (Example 2).

A fabric weave having a special weave plan as described in FIG. 2 was prepared. This fabric had 29 yarns/cm (warp) of TY1, 25 yarns/cm of TY1 and a specific weight of 195 g/m$^2$.

The same physical tests as in Example 1 were carried out on the fabric described in this Example 2.

The results are given in Table I.

TABLE I

| | Example 1 (Invention) | Example 2 (Comparative) |
|---|---|---|
| Physical Properties | | |
| Fabric weight | 185 g/m2 | 195 g/m2 |
| Breaking Strength (ISO 5081) Warp | 1320 N | 1150 N |
| Breaking Strength (ISO 5081) Weft | 1220 N | 1150 N |
| Tear Strength (ISO 4674/2) Warp | 95 N | 85 N |
| Tear Strength (ISO 4674/2) Weft | 112 N | 75 N |
| Air-permeability (ISO 9237) | 398 l/m$^2$/s | 164 l/m$^2$/s |
| Thermal Properties | | |
| TPP (ISO-FDIS 17492) (Fabric) | 11.7 cal/cm$^2$ | 12.1 cal/cm$^2$ |
| TPP (ISO-FDIS 17492) (Garment) | 41.1 cal/cm$^2$ | 34.5 cal/cm$^2$ |
| FFF (Fabric) | 6.3 $10^{-2}$ cal/g | 6.2 $10^{-2}$ cal/g |
| FFF (Garment) | 7.2 $10^{-2}$ cal/g | 5.9 $10^{-2}$ cal/g |

Table 1 shows that the physical and thermal properties of the fabric according to the present invention (Example 1) are much better than those of the comparative fabric (Example 2), although the latter fabric has a greater specific weight. The improvement of the fabric performance is in particular with regard to the air permeability and to its thermal protection when used as outershell of a garment. Better values of these features enable not only to increase the protection against heat and flame, but also to increase the wear comfort and the heat and vapor dissipation of the fabric.

Example 3 (Comparative)

A fabric structure was prepared according to the teaching of prior art document WO 00/066823, that is a structure comprising a woven faced fabric and a woven mesh back of low thermal shrinkage.

The fabric face was made of a blend of fibers, commercially available from E. I. du Pont de Nemours and Company, Wilmington, Del., USA under the trade name Nomex® N307, having a cut length of 5 cm and consisting of:

93 wt-% of pigmented poly-metaphenylene isophthalamide (meta-aramid), 1.4 dtex staple fibers;

5 wt-% of poly-paraphenylene terephthalamide (para-aramid) 1.7 dtex fibers; and 2 wt-% of carbon fibers sheeted with polyamide (antistatic fibers);

such blend of fibers was ring spun as in Example 1 into a twisted staple yarn using a conventional cotton staple processing equipment. The obtained twisted staple yarn had a linear density of Nm 40/2 or 500 dtex.

A woven mesh back made of para-aramid staple yarn was woven together with the face material according to the document WO 00/066823.

The final composition of the fabric was 89 wt-% meta-aramid, 9 wt-% para-aramid and about 2 wt-% antistatic fiber. The specific weight of the fabric was 215 g/m$^2$.

Example 4 (Comparative)

A fabric structure was prepared according to the teaching of prior art document WO 02/079555, that is a reinforced fabric comprising a ground fabric having on its rear surface a reinforced grid consisting of warp and weft yarns produced in a material having higher mechanical properties than those producing the yarns of the ground fabric. In such reinforced fabric, the reinforcing grid is linked to the ground fabric by its warp and weft yarns which are fixed on the ground fabric in different points and which intersect each other outside the ground fabric.

The fabric face was made of a blend of fibers, commercially available from E.I. du Pont de Nemours and Company, Wilmington, Del., USA under the trade name Nomex® N307, having a cut length of 5 cm and consisting of:

93 wt-% of pigmented poly-metaphenylene isophthalamide (meta-aramid), 1.4 dtex staple fibers;

5 wt-% of poly-paraphenylene terephthalamide (para-aramid) 1.7 dtex fibers; and 2 wt-% of carbon fibers sheeted with polyamide (antistatic fibers);

such blend of fibers was ring spun as in Example 1 into a twisted staple yarn using a conventional cotton staple processing equipment. The obtained twisted staple yarn had a linear density of Nm 60/2 or 333 dtex.

A reinforcing grid made of para aramid staple yarn was linked to the ground fabric by its warp and weft yarns which were fixed on the ground fabric in different points and which intersected each other outside the ground fabric according to the document WO 02/079555.

The final composition of the fabric was 82 wt-% meta-aramid, 16 wt-% para-aramid and about 2 wt-% antistatic fiber. The specific weight of the fabric was 220 g/m$^2$.

Table II shows the FFF and TPP values, as well as the air permeability of the fabric according to the present invention (Example 1) and of the fabrics of Comparative Examples 2, 3 and 4. The FFF and TPP values have been obtained by testing the fabrics as outershell of a garment as described in Example 1, while the air permeability was tested on the fabrics as single layer.

TABLE II

| | Example 1 invention | Example 2 | Example 3 | Example 4 |
|---|---|---|---|---|
| FFF (Garment) | 7.2 $10^{-2}$ cal/g | 5.9 $10^{-2}$ cal/g | 6.4 $10^{-2}$ cal/g | 5.8 $10^{-2}$ cal/g |
| TPP (Garment) (ISO-FDIS 17492) | 41.1 cal/cm$^2$ | 34.5 cal/cm$^2$ | 38.5 cal/cm$^2$ | 34.1 cal/cm$^2$ |
| Air-permeability (Fabric) (ISO 9237) | 398 l/m$^2$/s | 164 l/m$^2$/s | 271 l/m$^2$/s | 110 l/m$^2$/s |

Table II shows that the fabric according to the present invention has the highest FFF value among all fabrics which have been tested, so that its performance in terms of thermal protection per unit of specific weight is not only much better than that of Comparative Example 2, but even much better than that of the prior art materials described in Examples 3 and 4 which are semi double weave structures.

The air permeability of the fabric of the invention is significantly higher than that of the prior art fabric so that the heat stress is decreased and the wearer's comfort strongly improved.

Table II also shows that the overall protection (TPP value) of the garment having as outershell the fabric according to the present invention is better than that of any other garment having as outershell the fabrics of Comparative Examples 2 to 4. This will confer to the wearer a higher protection at a reduced overall weight of the garment.

What is claimed is:

1. Heat and flame resistant single ply fabric for use as single layer of a protective garment for a wearer, characterized in that the fabric comprises interwoven warp and weft yarns wherein each of the warp yarns comprises a blend of 60 to 90 wt-% poly-m-phenylenisophtalamid (meta-aramid) and 10 to 40 wt-% poly-p-phenylenterephtalamid (para-aramid), and the weft yarns comprise at least two weft yarns, the first of the at least two weft yarns comprising a blend of 85 to 95 wt-% meta-aramid and 5 to 15 wt-% para-aramid, the second of the at least two weft yarns essentially comprising para-aramid, and characterized in that the fabric is woven in such a way that from about 55 wt-% to about 80 wt-% of the warp yarns appear on the fabric side facing the wearer, from about 55 wt-% to about 80 wt-% of the first of the at least two weft yarns appears on the fabric side facing away the wearer and from about 70 wt-% to about 90 wt-% of the second of the at least two weft yarns appears on the fabric side facing the wearer.

2. The fabric according to claim 1, wherein the ratio between the first and the second of the at least two weft yarns is chosen in such a way that the total wt-% ratio between meta-aramid and para-aramid in the at least two weft yarns is substantially the same as the wt-% ratio between meta-aramid and para-aramid in the warp yarns.

3. The fabric according to claim 1, wherein the warp and weft yarns are, independently to each other, based on filaments, single yarns and twisted yarns.

4. The fabric according to claim 1, wherein the first of the at least two weft yarns comprise fibers having a linear mass from about 1.1 to about 1.4 dtex, the second of the at least two weft yarns comprise fibers having have a linear mass from about 1.7 to about 2.4 dtex, and the warp yarns comprise fibers having a linear mass from about 1.7 to about 2.2 dtex.

5. The fabric according to claim 1, wherein the first of the at least two weft yarns and the warp yarns comprise each up to 4 wt-% of antistatic fibers.

6. The fabric according to claim 1, wherein the warp and weft yarns are twisted yarns.

7. The fabric according to claim 1, having a specific weight from about 170 to about 250 g/m$^2$.

8. The fabric according to claim 1, having two weft yarns.

9. Garment for protection against heat and flames comprising a structure made of at least one layer of a fabric according to claim 1.

10. The garment according to claim 9, comprising an internal layer, optionally an intermediate layer made of a breathing waterproof material, and an outer layer where the outer layer is the at least one layer made of the fabric.

* * * * *